US006758366B2

(12) United States Patent
Bourgund et al.

(10) Patent No.: US 6,758,366 B2
(45) Date of Patent: Jul. 6, 2004

(54) BIN WITH A QUIETER-CLOSING LID

(75) Inventors: Hervé Bourgund, Langres (FR); Richard Gourlin, Langres (FR); Denis Obriot, Heulley Cotton (FR)

(73) Assignee: Campagnie Plastic Omnium, Lyons (FR)

( * ) Notice: Subject to any disclaimer, the term of this patent is extended or adjusted under 35 U.S.C. 154(b) by 0 days.

(21) Appl. No.: 09/788,579

(22) Filed: Feb. 21, 2001

(65) Prior Publication Data

US 2001/0017302 A1 Aug. 30, 2001

(30) Foreign Application Priority Data

Feb. 24, 2000 (FR) ..... 00 02318

(51) Int. Cl.[7] ..... B65D 43/14
(52) U.S. Cl. ..... 220/836; 220/908
(58) Field of Search ..... 220/836, 908, 220/840–846, 365.4, 824, 802, 800, 801, 4.22, 4.23, 244, 252, 894, 366.1, 262, 263, 899

(56) References Cited

U.S. PATENT DOCUMENTS 3,841,466 A * 10/1974 Hoffman et al. ..... 206/205
4,034,889 A * 7/1977 Hammes et al. ..... 220/324
4,917,257 A 4/1990 Edelhoff
4,971,220 A * 11/1990 Kaufman et al. ..... 220/335
5,031,796 A * 7/1991 Schafer et al. ..... 220/571
5,036,997 A * 8/1991 May et al. ..... 220/832
5,036,999 A * 8/1991 Bitsch ..... 220/627
5,366,104 A * 11/1994 Armstrong ..... 220/832
5,699,912 A * 12/1997 Ishikawa et al. ..... 206/494
6,481,588 B1 * 11/2002 Wagner ..... 215/235

* cited by examiner

*Primary Examiner*—Lien Ngo
(74) *Attorney, Agent, or Firm*—Oliff & Berridge, PLC

(57) ABSTRACT

A bin comprising a vessel and a pivoting lid that can be moved between an open position and a closed position. The lid and the vessel are arranged in such a manner that the air leaving the vessel during closure of the lid and when the lid is close to its closed position is forced to turn at least twice, being forced to pass between substantially vertical surfaces belonging respectively to the lid and to the vessel, at least at the front of the lid, preferably at least at the front of the lid and on both sides therefore, and more preferably still all round the four edges of the lid, so as to encourage the creation of raised pressure inside the vessel, which raised pressure tends to brake the displacement of the lid towards its closed position.

65 Claims, 7 Drawing Sheets

BIN WITH A QUIETER-CLOSING LID

The present invention relates to a bin or can for collecting waste.

The invention relates more particularly to a bin comprising a vessel and a pivoting lid that can be moved between an open position in which it allows waste to be put into the vessel and a closed position in which it rests on the periphery of the vessel.

BACKGROUND OF THE INVENTION

Such bins are commonly fitted with wheels.

To reduce noise nuisance, the vessel and/or the lid of certain known bins are provided with rubber abutments serving to damp the banging of the lid on the vessel.

Proposals have also been made to implement a brake in the hinge between the lid and the vessel so as to slow down the lid as it approaches its closed or open positions.

Such a brake is relatively difficult to make and, in addition, its effectiveness decreases over the lifetime of the bin because contacting portions are subject to wear.

U.S. Pat. No. 4,917,257 discloses braking a waste container lid by providing an upwardly projecting rib on the vessel of the container to co-operate with the edge of the lid to form an air flow baffle during closure of the bin.

It has been found out that characteristic does not provide sufficient braking and does not significantly reduce the noise created by the lid banging onto the vessel.

OBJECTS AND SUMMARY OF THE INVENTION

The invention seeks to reduce considerably the noise of closing the lid and to do so in a manner that is simple, effective, and constant throughout the lifetime of the bin.

The invention achieves this by the fact that the lid and the vessel are arranged in such a manner that the air leaving the vessel during closure of the lid and when the lid is close to its closed position is forced to turn at least twice, being forced to pass between substantially vertical surfaces belonging respectively to the lid and to the vessel, at least at the front of the lid, preferably at least at the front of the lid and on both sides thereof, and more preferably still all round the four edges of the lid, so as to encourage the creation of raised pressure inside the vessel, which raised pressure tends to brake the displacement of the lid towards its closed position.

By means of the invention, the lid is braked effectively without having to add rubber abutments to the vessel or the lid.

When such abutments are nevertheless still used, the invention provides advantages in that the speed of the lid when it reaches its closed position is reduced, such that the above-mentioned abutments are stressed to a lesser extent and can be smaller in size.

Furthermore, in the invention, the intensity of braking increases when the lid is slammed down harder against the vessel.

Preferably, the two vertical surfaces between which the air is forced to pass and which belong respectively to the lid and to the vessel are spaced apart by less than 50 millimeters (mm).

Advantageously, the lid has an inner wall or skirt on its inside surface, which inner wall is preferably shaped to engage inside the vessel when the bin is closed.

The spacing between the skirt or inner wall and the main walls of the vessel, when the bin is closed, can lie in the range 2 mm to 50 mm, for example.

Advantageously, the inner wall or skirt is of sufficient height to begin opposing the departure of the air contained inside the vessel and the lid while the lid is closing and is open at an angle of about 2.5°.

By way of example, the height of the inner wall or skirt along the front of the lid lies in the range 1 centimeter (cm) to 8 cm.

As in document U.S. Pat. No. 4,917,247, the bin may include a rib extending the main walls of the vessel around the opening thereof.

Advantageously, the rib extends around the inner wall or skirt when the bin is closed.

By way of example, the height of the above-mentioned rib along the front side can lie in the range 0 to 3 cm.

Advantageously, the lid has an outer skirt.

Preferably, the outer skirt of the lid extends around the above-mentioned rib when the bin is closed.

The inner skirt or wall of the lid advantageously presents varying height along the sides of the lid with height increasing towards the front, at least from a middle region of the lid situated halfway between the front and rear of the lid.

Thus, when the lid is in its open position, bearing against the rear wall of the vessel, and the bin is tilted by the hoisting mechanism of a collecting vehicle to empty the bin of its content, the risk of the lid catching on a member of the hoisting mechanism is reduced.

In a particular embodiment, the inner wall or skirt along the sides of the lid presents a height that increases from the vicinity of the rear edge of the lid going towards the front edge of the lid.

In another particular embodiment, the lid has an inner wall or skirt presenting a rounded profile along two opposite edges of the lid, preferably along two sides thereof, which profile is concave towards the vessel when the bin is closed, and the top wall of the lid is convex towards the outside, the profile of the inner skirt being selected in such a manner as to make it easier to stack lids prior to their assembly on the vessels of bins.

The bin can have a collar against which the outer skirt of the lid rests when the bin is closed.

At least at the front of the bin, this collar can include a downwardly-directed rim.

By way of example, this rim can serve to receive the ends of combs in the hoisting mechanism of the connection vehicle.

The vessel can also have two upwardly-directed parallel ribs, and the lid has a wall or skirt arranged to engage between said ribs when the bin is closed.

In a particular embodiment, the lid has an inner wall or skirt arranged to engage in the vessel when the bin is closed, and an outer skirt arranged to bear against a collar of the vessel, the bin further having a rib suitable for engaging between the inner and outer skirts of the lid.

In another particular embodiment, the vessel has a collar and two ribs, at least one of the ribs being carried by said collar, and the lid has an outer skirt arranged to engage between said ribs when the bin is closed. Preferably, the lid further has an inner wall or skirt arranged to engage inside the vessel when the bin is closed.

In another particular embodiment, the vessel has a collar and two ribs, at least one of the ribs being carried by said collar, and the lid has an inner wall or skirt arranged to engage between said two ribs, and has an outer skirt arranged to surround them when the bin is closed.

Still in a particular embodiment, the vessel has a collar presenting an upwardly-open channel, and the lid has an outer skirt arranged to engage in said channel when the bin is closed. Preferably, the lid also has an inner wall or skirt arranged to engage in the vessel when the bin is closed.

In a particular embodiment, the vessel has a collar presenting a step, and the lid has an outer skirt arranged to surround said collar and has an inner skirt arranged to bear on the base of said step when the bin is closed.

Still in a particular embodiment, the vessel has a collar with a rim that presents a step, and the lid has an outer skirt arranged to bear against the base of said step when the bin is closed, and an inner wall or skirt arranged to engage in the vessel.

In another particular embodiment, the vessel has a collar having, in section, a portion in the form of a crenellation, and the lid has a downwardly-open channel, the portion in the form of a crenellation of the collar being arranged to engage in the channel of the lid when the bin is closed.

Still in a particular embodiment, the vessel has a collar whose section presents a portion in the form of a crenellation, and the lid has an inner wall or skirt and an outer skirt arranged to take up positions on either side of said portion in the form of a crenellation when the bin is closed.

Still in a particular embodiment, the collar has a rim whose section is Γ-shaped, the bin has a rib extending the main walls of the vessel upwards, and the lid has a skirt or wall arranged to engage between the above-mentioned rim and said rib.

Still in a particular embodiment, the top edge of the vessel, at least at the front, forms an inwardly directed step, and the lid has an outer skirt suitable for bearing against the base of said step when the bin is closed, and has an inner wall or skirt arranged to engage inside the vessel.

The capacity of the bin can lie in the range 20 liters (l) to 2400 l.

BRIEF DESCRIPTION OF THE DRAWINGS

The invention will be better understood on reading the following detailed description of non-limiting embodiments, and on examining the accompanying drawings, in which.

MORE DETAILED DESCRIPTION

Figure 1:
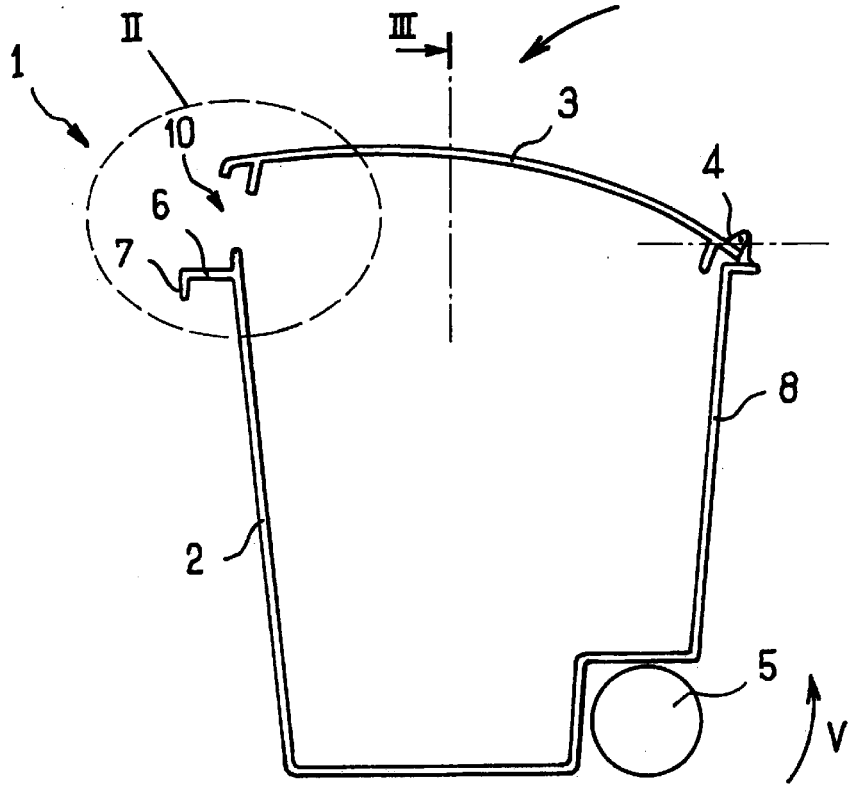
FIG. 1 is a diagrammatic section view of a bin of the invention.

The bin 1 shown in FIG. 1 comprises a vessel 2 and a lid 3 hinged via its rear edge 4 to the vessel 2 about a horizontal axis of rotation.

The vessel 2 and the lid 3 are made of plastics material.

The bin 1 is provided with wheels 5, there being two such wheels in the embodiment described.

The bin 1 has an outer collar 6 extending around the entire periphery of the top portion of the vessel 2.

The collar 6 has a horizontal plane wall terminated at its periphery by a downwardly-directed rim 7.

At the front of the bin, the rim 7 is of a shape that is adapted to receive the ends of the combs of a hoist mechanism on a collecting vehicle.

The bin 1 is emptied by being tilted forwards, i.e. in the direction of arrow V in FIG. 1.

When the bin 1 is open, the lid 3 rests against the rear wall 8 of the vessel 2.

To prevent the lid 3 making a loud noise when it is closed back down onto the vessel 2, means are provided for braking the closure movement of the lid.

These brake means are arranged in such a manner as to slow down the flow of air that is held captive inside the vessel 2 beneath the lid 3 while the bin 1 is being closed, and the brake means can be implemented in a variety of ways without thereby going beyond the ambit of the present invention.

FIGS. 2 to 16 show various embodiments.

All of these figures are diagrammatic and the proportions and relative positions of the various elements are not necessarily complied with in order to clarify the drawings.

Thus, the passages formed between the lid and the vessel to allow air to flow out can be narrower in practice than shown in the drawings.

Figure 2:
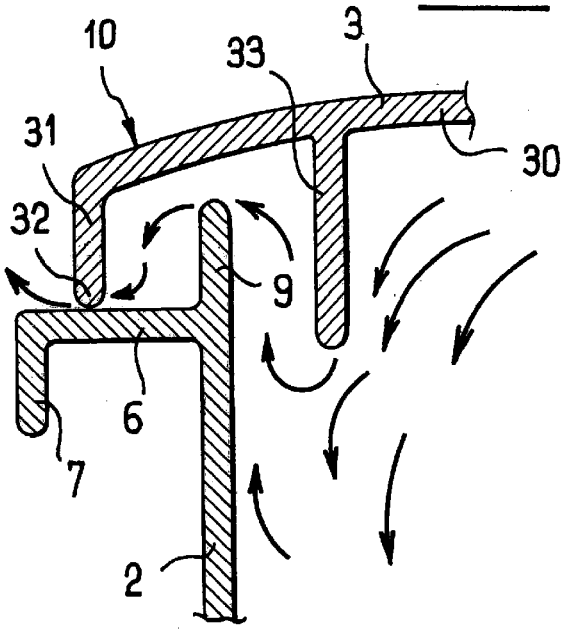
FIG. 2 corresponds to detail II of FIG. 1 when the lid is about to reach its closed position.

In the example of FIG. 2, the lid 3 has a slightly curved top wall 30 which is provided at its periphery with a downwardly-directed outer skirt 31 when the bin is closed.

The bottom end 32 of the outer skirt 31 bears against the collar 6 when the bin 1 is closed.

A tubular inner skirt 33 projects from the inside face of the top wall 30 of the lid 3.

This inner skirt 33 extends vertically when the bin 1 is closed, and it is then engaged inside the vessel 2.

The main walls of the vessel 2 are extended upwards above the collar 6 by a rib 9, which rib borders the opening to the vessel 2.

When the bin is closed, the inner skirt 33 of the lid comes into register with the rib 9 and comes to rest a short distance therefrom.

The spacing between the rib 9 and the inner skirt 33 when the bin 1 is closed is preferably less than 50 mm.

Also preferably, the spacing between the outer skirt 31 and the rib 9 is less than 50 mm when the bin 1 is closed.

All around the front, side, and rear of the lid 3, the outer and inner skirts 31 and 33 and the rib 9 constitute a baffle which forces the air expelled from the vessel 2 by closing the lid 3 to be deflected before it can reach the outside.

In this embodiment, the rib 9 is merely optional and, in a variant that is not shown, the baffle effect with the air changing direction twice can be achieved by making it flow around the inner skirt 33 and around the bottom end 32 of the outer skirt 31.

Figure 3:
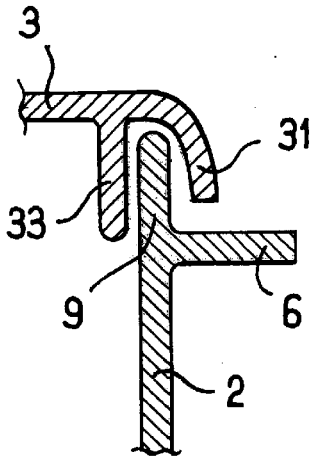
FIG. 3 is a fragmentary section through a side of the lid on section line III of FIG. 1 once the lid has reached its closed position.

In FIG. 3, it can be seen that the rib 9 engaged between the inner and outer skirts 33 and 31 along the sides of the lid 3 when the bin 1 is closed.

The movement of air while the lid 3 is being closed is represented by arrows in FIG. 2.

It will be understood that the air is forced to pass round the bottom of the inner skirt 33 whose height at the front of the lid 3 is 35 mm, for example, prior to the air then being constrained to rise in the narrow space between the inner skirt 33 and the rib 9, after which it is again deflected downwards by the outer skirt 31 prior to being able to escape through the gap left between the bottom edge 32 of the outer skirt 31 and the collar 6.

Thus, the movement whereby the lid 3 is closed brings more air into the vessel 2 than is capable of escaping through the gap between the lid 3 and the vessel, thereby tending to cause the pressure inside the vessel 2 to rise momentarily, which increase in pressure brakes the movement of the lid 3.

The lid 3 is thus slowed down before it reaches its closed position (where the lid bears against the rib 9) and the noise generated by the lid 3 banging against the vessel 2 is reduced.

Figure 4:
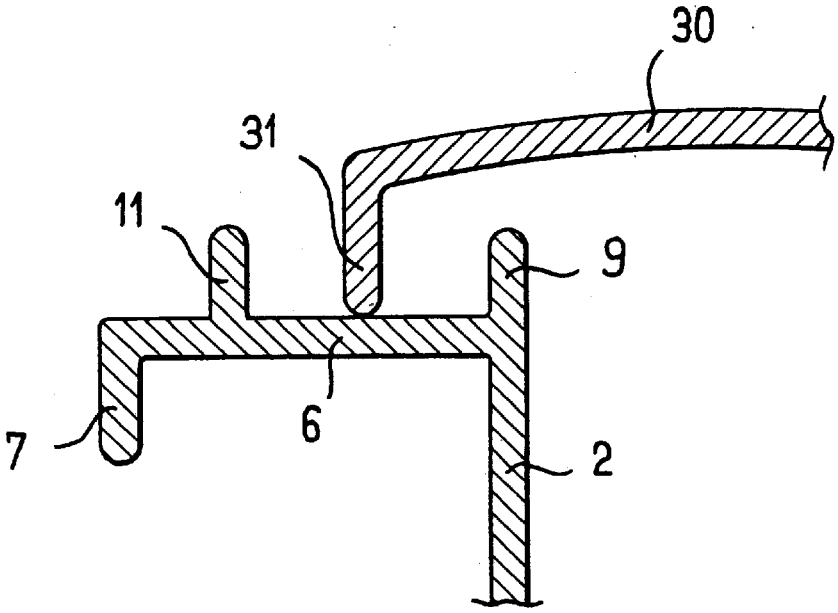
FIGS. 4 to 16 and 20 show various configurations for the lid and the vessel.

The embodiment of FIG. 4 differs from the preceding embodiment by the absence of an inner skirt 33 and by the presence of a second rib 11 parallel to the rib 9, so that the outer skirt 31 engages between the ribs 9 and 11.

The height of the rib 11 lies in the range 2 mm to 50 mm, for example.

The thickness of the skirt 31 is 4 mm, for example.

The spacing between the ribs 9 and 11 lies in the range 5 mm to 100 mm, for example.

Figure 5:
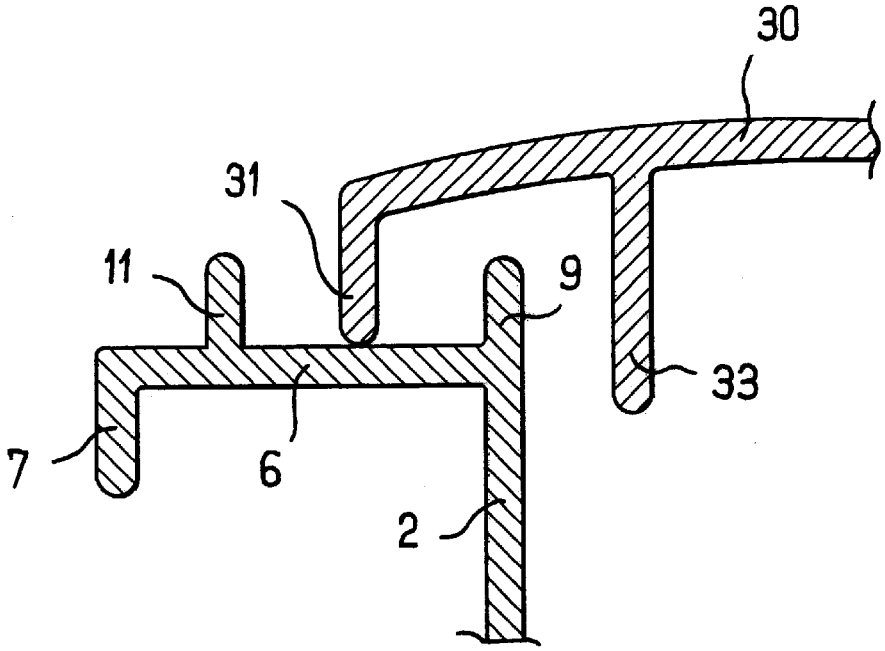
Figure 6:
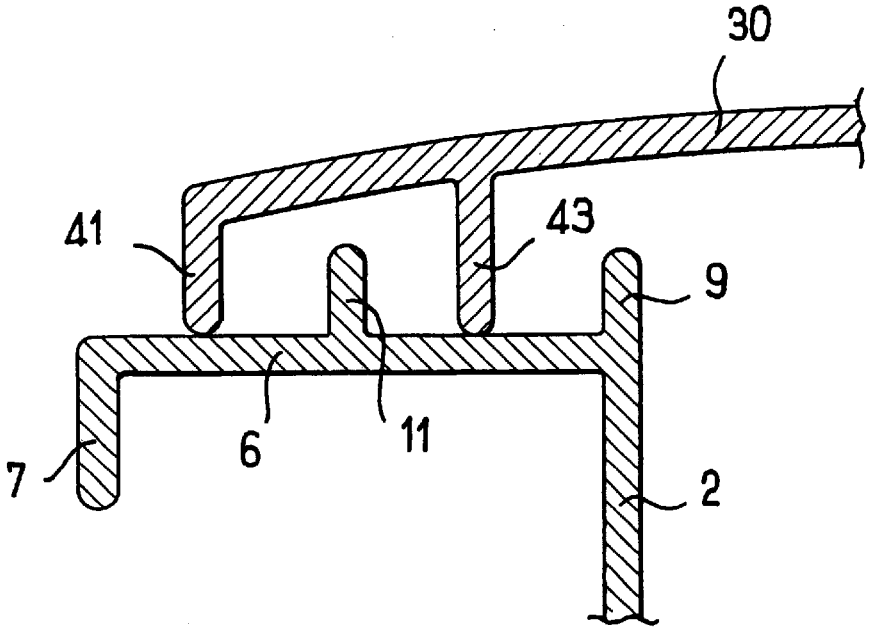

The embodiment of FIG. 5 differs from the preceding embodiment by the presence of an inner skirt 33 as well, like the embodiment of FIG. 2;

In the embodiment of FIG. 6, the bin has ribs 9 and 11, as in the embodiment of FIG. 5, and the lid 3 has outer and inner skirts 41 and 43.

The collar 6 is relatively wide.

The outer skirt 41 bears against the collar 6 when the bin is closed outside the rib 11, while the inner skirt 43 engages between the ribs 9 and 11.

The spacing between the outer skirt 41 and the rib 11 lies in the range 2 mm to 50 mm, for example.

The spacing between the inner skirt 43 and the rib 11 lies in the range 2 mm to 50 mm, for example.

The spacing between the rib 9 and the inner skirt 43 lies in the range 2 mm to 50 mm, for example.

Figure 7:
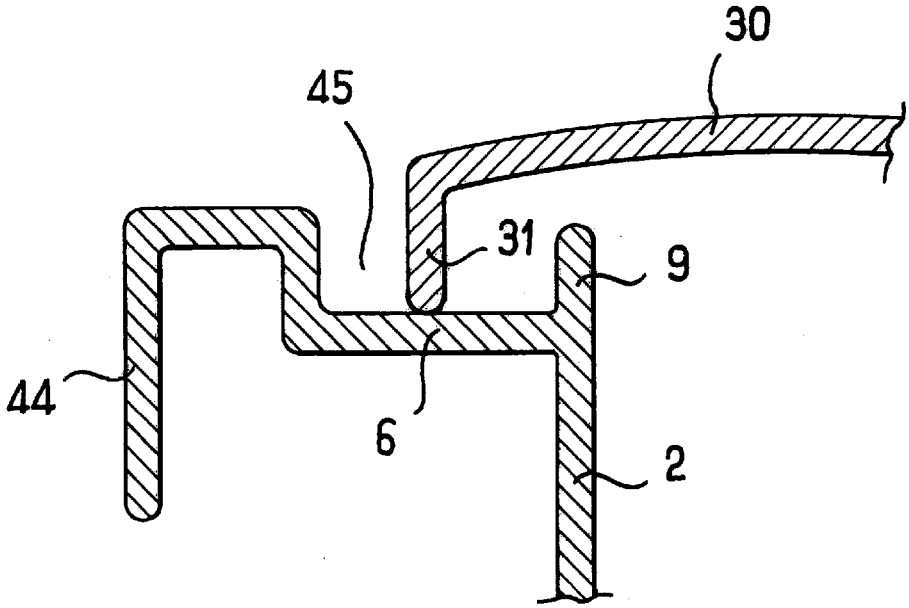

In the embodiment of FIG. 7, the collar 6 is not extended by a downwardly-extending rim 7 as in the embodiments of FIGS. 2 to 6, but has a peripheral portion 44 with a generally Γ-shaped section.

This peripheral portion 44 co-operates with the rib 9 to define an upwardly-open channel 45 in which the outer skirt 31 of the lid engages when the bin 1 is closed.

The width of the channel 45 lies in the range 2 mm to 100 mm, for example.

Thus, the spacing between the outer skirt 31 and each of the uprights of the collar 6 defining the channel 45 lies in the range 2 mm to 100 mm.

Figure 8:
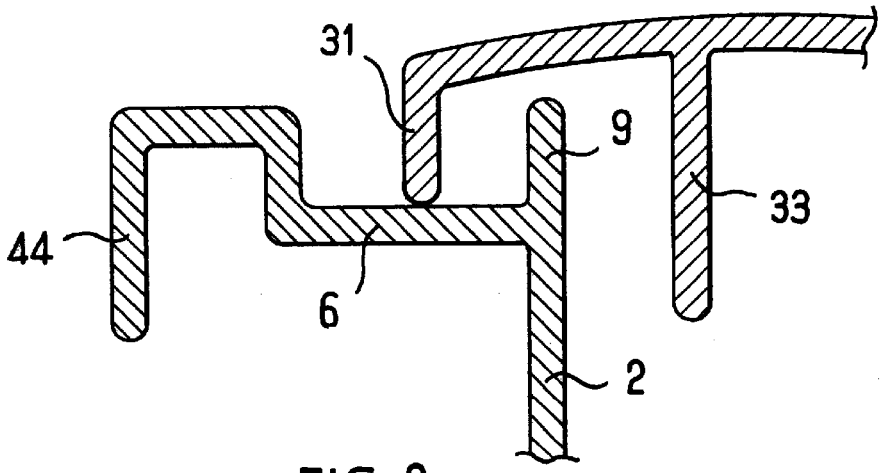

The embodiment of FIG. 8 differs from that of FIG. 7 by the presence of the inner skirt 33 which is shaped to engage inside the vessel 2.

The spacing between the inner skirt 33 and the rib 9 lies in the range 2 mm to 50 mm, for example.

Figure 9:
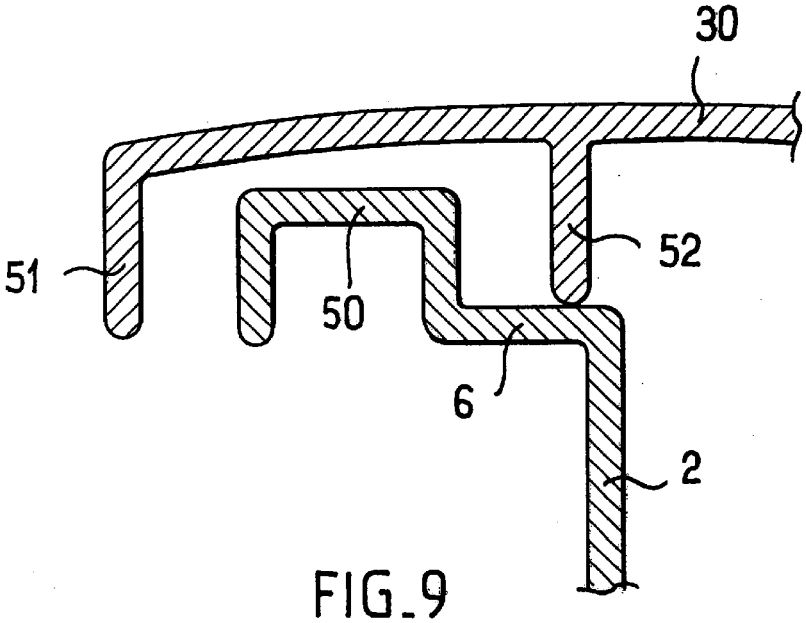

In the embodiment of FIG. 9, the collar 6 is terminated by a peripheral portion 50 whose section forms a crenellation.

The lid has an outer skirt 51 and an inner skirt 52 which engage respectively on either side of this portion 50 when the lid is closed.

The spacing between each of the skirts 51 and 52 and said portion 50 lies in the range 1 cm to 15 cm, for example.

Figure 10:
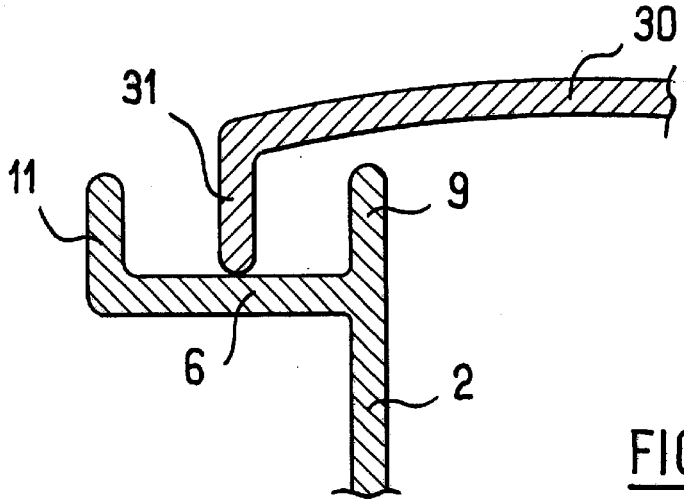

The embodiment of FIG. 10 is quite close to that of FIG. 4 and differs therefrom by the absence of the rim 7, the collar 6 being terminated by the rib 11.

Figure 11:
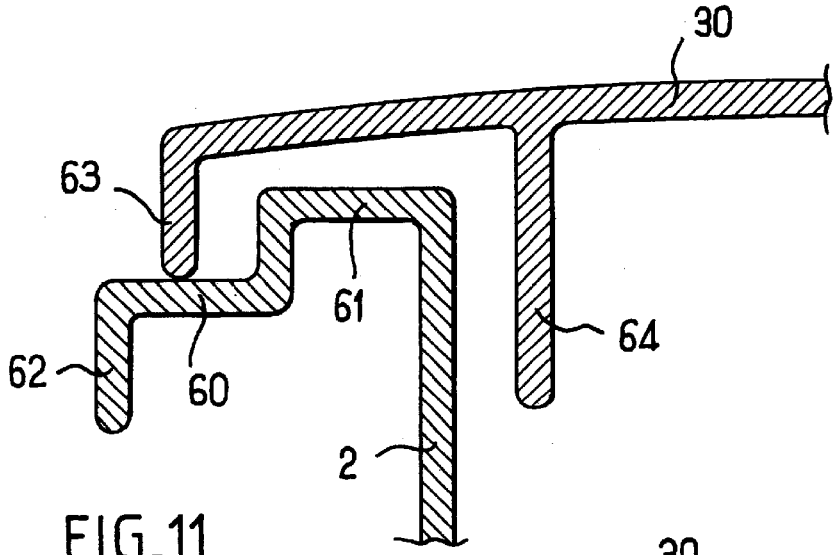

In the embodiment of FIG. 11, the collar is stepped and has, going from the outside towards the inside: first and second steps 60 and 61, with the second step being higher than the first.

The collar is provided at its periphery with a downwardly-directed rim 62.

The lid has an outer skirt 63 and an inner skirt 64.

The spacing between the skirts lies in the range 1 cm to 15 cm, for example.

The outer skirt 63 rests on the first step 60 when the lid is closed, while the inner skirt 64 takes up a position that is at a short distance from the inside wall of the vessel.

The spacing between the outer skirt 63 and the riser of the second step 61 can lie in the range 2 mm to 50 mm, for example.

Figure 12:
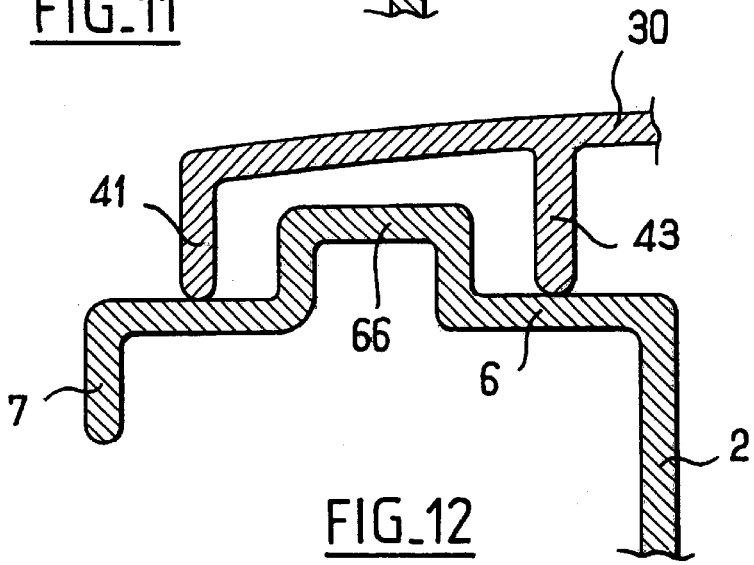

In the embodiment of FIG. 12, the lid is similar in shape to the lid of FIG. 6, with outer and inner skirts 41 and 43.

Compared with the embodiment of FIG. 6, the bin 1 does not have a rib 9 and the collar 6 does not have a rib 11.

In section, between the outer and inner skirts 41 and 43 of the lid, the collar 6 has a crenellation-forming portion 66.

The outer and inner skirts 41 and 43 are situated on respective sides of said portion 66 when the bin is closed.

Figure 13:
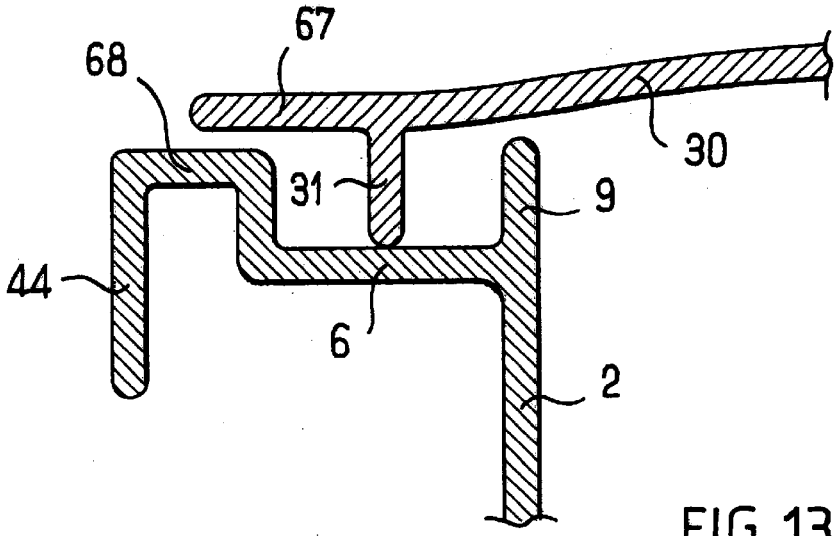

The embodiment of FIG. 13 is similar to that of FIG. 7 and differs by the fact that the periphery of the lid has a top wall 30 extending beyond the skirt 31, so as to form a substantially horizontal rib 67 when the bin is closed, partially overlying the top wall 68 of the peripheral portion 44.

Figure 14:
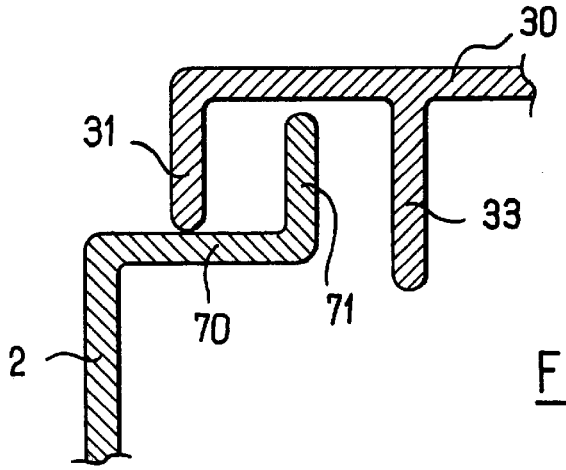

In the embodiment of FIG. 14 the collar which is referenced 70 extends inwards, i.e. into the opening of the vessel, and it is terminated by an upwardly-directed rim 71.

Like the embodiment of FIG. 8, the lid has an outer skirt 31 and an inner skirt 33, the outer skirt 31 resting behind the rim 71 on the collar 70 while the lid is closed, and the inner skirt 33 then extending in register with the rim 71.

The spacing between the skirt 31 and the rim 71 lies in the range 2 mm to 50 mm, for example, and is preferably less than 15 mm.

The spacing between the skirt 33 and the rim 71 lies in the range 2 mm to 50 mm, for example, and is preferably less than 15 mm.

The height of the rim 71 lies in the range 0 to 2 cm, for example.

The height of the skirt 33 at the front of the lid lies in the range 1 cm to 8 cm, for example.

Figure 15:
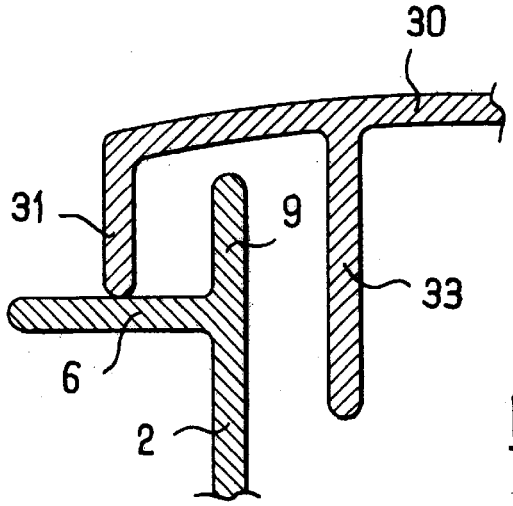

The embodiment of FIG. 15 differs from that of FIG. 2 by the absence of the rim 7.

Figure 16:
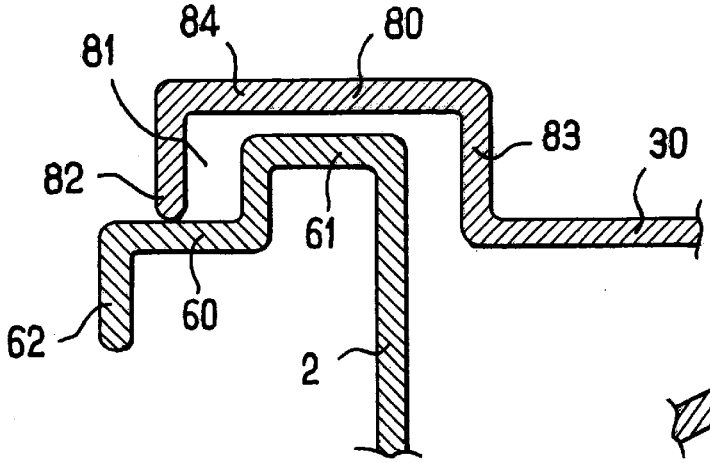

In the embodiment of FIG. 16, the vessel 2 has a collar identical to that described with reference to FIG. 11.

The top wall of the lid has a peripheral portion 80 with a crenellation-shaped cross-section that defines a downwardly-open channel 81.

The width of this channel lies in the range 1 cm to 10 cm, for example.

The channel 81 is defined by vertical uprights 82 and 83 that are substantially parallel, these uprights being united by a top wall 84 that is horizontal when the bin is closed.

The upright 82 which also constitutes the outer skirt of the lid comes to bear against the first step 60 of the collar.

The upright 83 which, so to speak, constitutes the inner skirt of the lid, takes up a position facing the inside surface of the main walls of the vessel.

When the lid has an inner skirt, such as the skirt 33 in the embodiment of FIG. 2, for example, the height of said skirt can vary depending on location around the lid.

Figure 17:
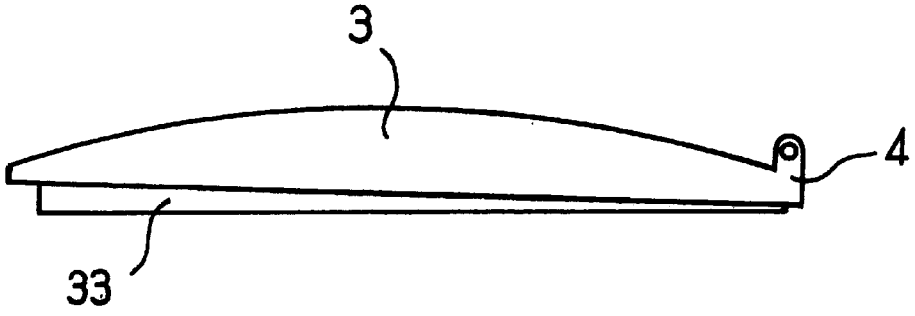
FIGS. 17 to 19 show three variant embodiments of the lid.

Thus, as shown in FIG. 17, it is possible to have an inner skirt 33 of height that increases progressively along the sides of the lid from the rear edge 4 thereof going towards its front edge.

When the bin is open and the lid 3 is resting against the rear wall 8 of the vessel 2, this ensures that a setback is not formed which might catch on part of the hoist mechanism of the collection vehicle.

Figure 18:
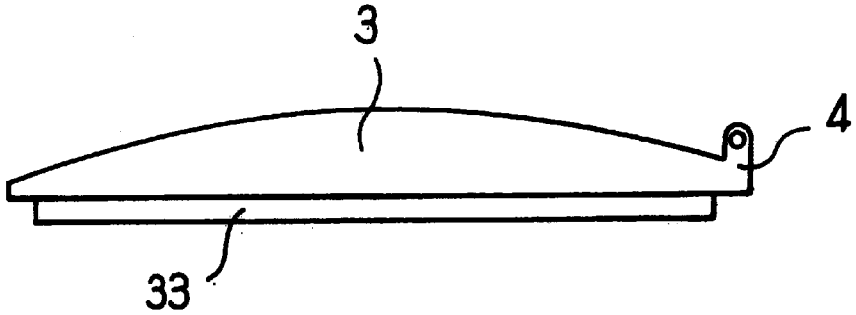

Naturally, the inner skirt 33 can be of constant height, as shown in FIG. 18.

Figure 19:
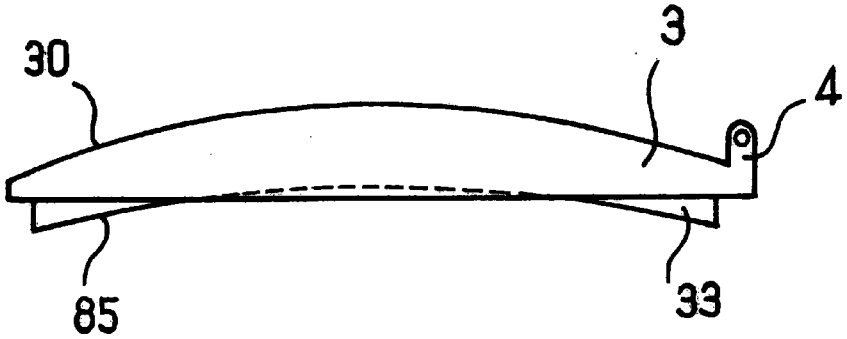

As shown in FIG. 19, it is also possible to make the inner skirt 33 so that it is of maximum height in the vicinity of the front and rear edges of the lid while being of decreasing height towards the middle region of the lid so that its height is at a minimum in the middle, with this decrease preferably taking place in such a manner that the bottom edge 85 of the inner skirt 33 is parallel to the top wall 30 of the lid.

This makes it easier to stack lids before they are assembled onto vessels.

Naturally, the invention is not limited to the embodiments described above.

Figure 20:
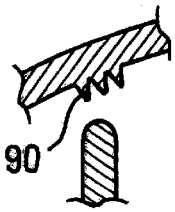

In particular, as shown in FIG. 20, it is possible to make portions in relief such as stripes 90 on the lid or the vessel so as to create additional head loss to brake the flow of air leaving the vessel.

What is claimed is:

1. A bin comprising a vessel and a pivoting lid that can be moved between an open position and a closed position, the vessel having at least one collar, wherein the lid and the vessel are arranged in such a manner that air leaving the vessel during closure of the lid and when the lid is close to its closed position is forced to turn at least thrice, being forced to pass through an air passage defined by a gap between substantially vertical surfaces belonging respectively to the lid and to the vessel, at least at a front of the lid, so as to encourage the creation of raised pressure inside the vessel, which raised pressure tends to brake the displacement of the lid as the lid travels towards its closed position, wherein all of said substantially vertical surfaces are spaced apart from each other when the lid is in its closed position, wherein at least one substantially vertical surface belonging to the lid has a free end that rests only on said collar when the lid is in its closed position and is spaced apart from said collar when the lid is in its open position, and wherein the lid is deprived of perforations.

2. A bin according to claim 1, wherein the lid has an inner wall or skirt on its inside surface.

3. A bin according to claim 2, wherein the inner wall or skirt is of sufficient height to begin opposing the departure of the air contained inside the vessel and the lid while the lid is closing and is open at an angle of about 2.5°.

4. A bin according to claim 2, wherein the height of the inner wall or skirt along the front of the lid lies in the range 1 cm to 8 cm.

5. A bin according to claim 1, wherein the vessel has a rib disposed in line with the main walls of the vessel, running around the opening of the vessel.

6. A bin according to claim 5, wherein the lid has an inner wall or skirt on its inside surface, wherein the rib extends around the inner wall or skirt when the bin is closed.

7. A bin according to claim 1, wherein the lid has an outer skirt.

8. A bin according to claim 5, wherein the lid has an outer skirt, wherein said outer skirt extends around the rib when the bin is closed.

9. A bin according to claim 1, wherein the lid has an inner wall or skirt of varying height along the sides of the lid, height increasing towards the front at least from a middle region of the lid situated halfway between its front and rear edges.

10. A bin according to claim 9, wherein the inner wall or skirt along the sides of the lid presents a height that increases form the vicinity of the rear edge of the lid going towards the front edge of the lid.

11. A bin according to claim 1, wherein the lid has an inner wall or skirt presenting a rounded profile along two opposite edges of the lid, which profile is concave towards the vessel when the bin is closed, and wherein the top wall of the lid is convex towards the outside, the profile of the inner skirt being selected in such a manner as to make it easier to stack lids prior to their assembly on the vessels of bins.

12. A bin according to claim 1, wherein the lid has an outer skirt arranged to rest on said collar when the bin is closed.

13. A bin according to claim 12, wherein said collar has a downwardly-directed rim at least at the front of the bin.

14. A bin according to claim 1, wherein the vessel has two upwardly-directed parallel ribs, and wherein the lid has a wall or skirt arranged to engage between said ribs when the bin is closed.

15. A bin according to claim 1, wherein the lid has an inner wall or skirt arranged to engage in the vessel when the bin is closed, and an outer skirt arranged to bear against a collar of the vessel, the bin further having a rib suitable for engaging between the inner and outer skirts of the lid.

16. A bin according to claim 1, wherein the vessel has two ribs, at least one of the ribs being carried by said collar, and wherein the lid has an outer skirt arranged to engage between said ribs when the bin is closed.

17. A bin according to claim 16, wherein the lid further has an inner wall or skirt arranged to engage inside the vessel when the bin is closed.

18. A bin according to claim 1, wherein the vessel has two ribs, at least one of the ribs being carried by said collar, and wherein the lid has an inner wall or skirt arranged to engage between said two ribs, and has an outer skirt arranged to surround them when the bin is closed.

19. A bin according to claim 1, wherein the collar has an upwardly-open channel, and wherein the lid has an outer skirt arranged to engage in said channel when the bin is closed.

20. A bin according to claim 19, wherein the lid also has an inner wall or skirt arranged to engage in the vessel when the bin is closed.

21. A bin according to claim 1, wherein the collar has a step, and wherein the lid has an outer skirt arranged to surround said collar and has an inner skirt arranged to bear on the base of said step when the bin is closed.

22. A bin according to claim 1, wherein the collar has a rim that presents a step, and wherein the lid has an outer skirt arranged to bear against the base of said step when the bin is closed, and an inner wall or skirt arranged to engage in the vessel.

23. A bin according to claim 1, wherein the collar has, in section, a portion in the form of a crenellation, and the lid has a downwardly-open channel, the portion in the form of a crenellation of the collar being arranged to engage in the channel of the lid when the bin is closed.

24. A bin according to claim 1, wherein the collar has a section with a portion in the form of a crenellation, and wherein the lid has an inner wall or skirt and an outer skirt arranged to take up positions on either side of said portion in the form of a crenellation when the bin is closed.

25. A bin according to claim 1, wherein the collar has a rim whose section is Γ-shaped, wherein the bin has a rib extending the main walls of the vessel upwards, and wherein the lid has a skirt or wall arranged to engage between the above-mentioned rim and said rib.

26. A bin according to claim 1, wherein the top edge of the vessel, at least at the front, forms an inwardly directed step, and wherein the lid has an outer skirt suitable for bearing against the base of said step when the bin is closed, and has an inner wall or skirt arranged to engage inside the vessel.

27. A bin according to claim 1, wherein at least one of the lid and the vessel includes portions in relief such as stripes for the purpose of braking air flow.

28. A bin according to claim 1, wherein the lid has a front, a back and two sides, and said vertical surfaces are at least at the front of the lid and on both sides of the lid.

29. A bin according to claim 1, wherein the lid has four edges and said vertical surfaces extend around the four edges of the lid.

30. A bin according to claim 2, wherein said inner wall is shaped to engage inside the vessel when the bin is closed.

31. A bin according to claim 6, wherein said inner wall is shaped to engage inside the vessel when the bin is closed.

32. A bin according to claim 11, wherein said rounded profile is along two sides of the lid.

33. A bin comprising:

a vessel having at least one collar;

a pivoting lid that can be moved between an open position and a closed position;

two first substantially vertical walls on one of the lid and the vessel, the two first substantially vertical walls extending at least at a front of the bin; and at least one second substantially vertical wall on the other one of the lid and the vessel which is configured to penetrate between the two first substantially vertical walls when the lid is close to its closed position, such that said first substantially vertical walls overlap the at least one second substantially vertical wall, at least partially, wherein said substantially vertical walls do not contact each other when the lid is in its closed position, and wherein at least one substantially vertical wall belonging to the lid has a free end that rests only on said collar when the lid is in its closed position and is spaced apart from said collar when the lid is in its open position.

34. A bin according to claim 33, wherein the lid has an inner or skirt on its inside surface.

35. A bin according to claim 34, wherein the inner wall or skirt is of sufficient height to begin opposing the departure of the air contained inside the vessel and the lid while the lid is closing and is open at an angle of about 2.5<.

36. A bin according to claim 34, wherein the height of the inner wall or skirt along the front of the lid lies in the range 1 cm to 8 cm.

37. A bin according to claim 33, wherein the vessel has a rib disposed in line with the main walls of the vessel, running around the opening of the vessel.

38. A bin according to claim 37, wherein the lid has an inner wall or skirt on its inside surface, wherein the rib extends around the inner wall or skirt when the bin is closed.

39. A bin according to claim 33, wherein the lid has an outer skirt.

40. A bin according to claim 37, wherein the lid has an outer skirt, wherein said outer skirt extends around the rib when the bin is closed.

41. A bin according to claim 33, wherein the lid has an inner wall or skirt of varying height along the sides of the lid, height increasing towards the front at least from a middle region of the lid situated halfway between its front and rear edges.

42. A bin according to claim 33, wherein the inner wall or skirt along the sides of the lid presents a height that increases from the vicinity of the rear edge of the lid going towards the front edge of the lid.

43. A bin according to claim 33, wherein the lid has an inner wall or skirt presenting a rounded profile along two opposite edges of the lid, which profile is concave towards the vessel when the bin is closed, and wherein the top wall of the lid is convex towards the outside, the profile of the inner skirt being selected in such a manner as to make it easier to stack lids prior to their assembly on the vessels of bins.

44. A bin according to claim 33, wherein the lid has an outer skirt arranged to rest on said collar when the bin is closed.

45. A bin according to claim 44, wherein said collar has a downwardly-directed rim at least at the front of the bin.

46. A bin according to claim 33, wherein the vessel has two upwardly-directed parallel ribs, and wherein the lid has a wall or skirt arranged to engage between said ribs when the bin is closed.

47. A bin according to claim 33, wherein the lid has an inner wall or skirt arranged to engage in the vessel when the bin is closed, and an outer skirt arranged to bear against a collar of the vessel, the bin further having a rib suitable for engaging between the inner and outer skirts of the lid.

48. A bin according to claim 33, wherein the vessel has two ribs, at least one of the ribs being carried by said collar, and wherein the lid has an outer skirt arranged to engage between said ribs when the bin is closed.

49. A bin according to claim 48, wherein the lid further has an inner wall or skirt arranged to engage inside the vessel when the bin is closed.

50. A bin according to claim 33, wherein the vessel has two ribs, at least one of the ribs being carried by said collar, and wherein the lid has an inner wall or skirt arranged to engage between said two ribs, and has an outer skirt arranged to surround them when the bin is closed.

51. A bin according to claim 33, wherein the collar has an upwardly-open channel, and wherein the lid has an outer skirt arranged to engage in said channel when the bin is closed.

52. A bin according to claim 51, wherein the lid also has an inner wall or skirt arranged to engage in the vessel when the bin is closed.

53. A bin according to claim 33, wherein the collar has a step, and wherein the lid has an outer skirt arranged to surround said collar and has an inner skirt arranged to bear on the base of said step when the bin is closed.

54. A bin according to claim 33, wherein the collar has a rim that presents a step, and wherein the lid has an outer skirt arranged to bear against the base of said step when the bin is closed, an inner wall or skirt arranged to engage in the vessel.

55. A bin according to claim 33, wherein the collar has a section with a portion in the form of a crenellation, and the lid has a downwardly-open channel, the portion in the form of a crenellation of the collar being arranged to engage in the channel of the lid when the bin is closed.

56. A bin according to claim 33, wherein the collar has a section with a portion in the form of a crenellation, and wherein the lid has an inner wall or skirt and an outer skirt arranged to take up positions on either side of said portion in the form of a crenellation when the bin is closed.

57. A bin according to claim 33, wherein the collar has a rim whose section is Γ-shaped, wherein the bin has a rib extending the main walls of the vessel upwards, and wherein the lid has a skirt or wall arranged to engage between the above-mentioned rim and said rib.

58. A bin according to claim 33, wherein the top edge of the vessel, at least at the front, forms an inwardly directed step, and wherein the lid has an outer skirt suitable for bearing against the base of said step when the bin is closed, and has an inner wall or skirt arranged to engage inside the vessel.

59. A bin according to claim 33, wherein at least one of the lid and the vessel includes portions in relief such as stripes for the purpose of braking air flow.

60. A bin according to claim 33, wherein the lid has a front, a back and two sides, and said vertical surfaces are at least at the front of the lid and on both sides of the lid.

61. A bin according to claim 33, wherein the lid has four edges and said vertical surfaces extend around the four edges of the lid.

62. A bin according to claim 34, wherein said inner wall is shaped to engage inside the vessel when the bin is closed.

63. A bin according to claim 38, wherein said inner wall is shaped to engage inside the vessel when the bin is closed.

64. A bin according to claim 43, wherein said rounded profile is along two sides of the lid.

65. A bin comprising:

a vessel having at least one collar;

a pivoting lid that can be moved between an open position and a closed position;

two first substantially vertical walls on one of the lid and the vessel, the two first substantially vertical walls extending at least at a front of the bin; and at least one second substantially vertical wall on the other one of the lid and the vessel which is configured to penetrate between the two first substantially vertical walls when the lid is close to its closed position, wherein said substantially vertical walls do not contact each other when the lid is in its closed position, wherein at least one substantially vertical wall belonging to the lid has a free end that rests only on said collar when the lid is in its closed position and is spaced apart from said collar when the lid is in its open position, and wherein the lid is deprived of perforations.

* * * * *

UNITED STATES PATENT AND TRADEMARK OFFICE

CERTIFICATE OF CORRECTION

PATENT NO. : 6,758,366 B2
DATED : July 6, 2004
INVENTOR(S) : Herve Bourgund et al.

It is certified that error appears in the above-identified patent and that said Letters Patent is hereby corrected as shown below:

Title page,
Item [73], Assignee, please change "Campagnie Plastic Omnium, Lyons (FR)" to -- Compagnie Plastic Omnium, Lyon (FR) --.

Signed and Sealed this

Fifth Day of October, 2004

JON W. DUDAS
*Director of the United States Patent and Trademark Office*